United States Patent [19]

Wurfel

[11] 4,030,089

[45] June 14, 1977

[54] ALARM SYSTEM

[76] Inventor: Wolfgang Wurfel, Konigsteinstrasse 12, 8000 Munich 40, BRD, Germany

[22] Filed: Apr. 2, 1976

[21] Appl. No.: 672,973

[52] U.S. Cl. ..... 340/274 R; 324/34 PS; 340/258 C

[51] Int. Cl.[2] ..... G08B 13/04; G08B 13/08

[58] Field of Search ..... 340/276, 27 S, 274 R, 340/282, 258 C; 324/34 PS, 34 D

[56] References Cited

UNITED STATES PATENTS

| | | | |
|---|---|---|---|
| 3,764,971 | 10/1973 | Brobeck | 340/63 X |
| 3,943,485 | 3/1976 | Waldman | 340/274 R |

*Primary Examiner*—Glen R. Swann, III

*Attorney, Agent, or Firm*—Burns, Doane, Swecker & Mathis

[57] ABSTRACT

An alarm system for warning of breakage of glass in a door, window, or the like includes a breakage-responsive sensor on the movable part of the door or window connected to a coil on a core supported on that part. A coil on a core fixed to the stationary frame for the door or window is magnetically coupled to the other coil when the door or window is closed to permit electrical energization of the sensor circuit from the latter coil and detection of load variations on that coil as an indication of sensor operation. Also a third coil on a core, located on the movable part and connected to the sensor circuit, may be similarly coupled to a fourth coil on a core located on the stationary part so that the fourth coil reflects the variation due to sensor operation and operates the alarm.

3 Claims, 4 Drawing Figures

ALARM SYSTEM

BACKGROUND AND OBJECTS OF THE INVENTION

The invention relates to an alarm system with a sensing arrangement, such as a glass break sensor, which system is connected with a source of electric power transmitted between movable and fixed parts.

For the security of buildings, it is well known to monitor weak points such as windows, doors, and other possible break-in points with electromechanic and electronic sensors connected in alarm circuits. Sensing arrangements such as glass break sensors, shock recorders or similar alarm generators have been applied to the surfaces that are to be monitored and connected electrically with a center providing a signal or an alarm.

For making electric connection between two movable parts that are to be monitored, as, for example, a movable wing or sash of a window and a fixed window frame, it has been the usual practice to employ either movable cable jumpers or relatively movable electromechanical contacts. These arrangements, however, are frequently the cause of system breakdowns. Thus, cable jumpers tend to break because of mechanical loads or strains due to frequent opening and closing of windows, doors, etc., whereas electromechanic contacts are pitted or fouled for similar reasons. This results in failures to the alarm system due to broken or ineffective connections. The object of the present invention is to provide alarm systems of a type which do not require direct electrical contact in the electrical transmission system between the relatively movable parts.

BRIEF SUMMARY

This object is accomplished in an alarm system of the type mentioned by using a first coil connected to an AC voltage disposed on first open core on one part and a second coil disposed on a second open core on the other part. The cores and coils are physically spaced or separated but are coupled by magnetic flux. In the case of a change in load brought about by action of the sensing arrangement on the second coil, a change results in load on the first coil, and that change is employed to provide a signal or alarm.

The alarm system according to the invention thus has the advantage that the sensing arrangement is fed from the fixed part via the first coil and the second coil is on the movable part. In the case of a change in load on the second coil brought about by the sensing arrangement, a change in load occurs in the first coil and can be reported in a suitable manner. On the basis of the contact-free interconnection or transmission, the disadvantages of the mechanical connection are avoided. Thus, the reliability of operation is not influenced by a very frequent opening and closing of the parts of the window, door or the like which is being monitored or protected. A further advantage lies in fact that the elements disposed on both the primary side and secondary side can be combined into such small units that they can be housed in folds, spaces, etc., in the construction so that the appearance of the windows, doors, etc. is not impaired. The alarm system is particularly advantageous in the case of windows which are rotatable around 360°and in the case of sliding doors. The primary unit with the first coil attached to the locally fixed part and the secondary unit with the second coil sitting on the movable part can be housed in easily mountable plastic housings for protection against adverse mechanical influences and weather.

Another advantage of the alarm system according to the invention is that a third coil attached to the second part on an open core may be connected with the sensing arrangement fed by the second coil, and a fourth coil on an open core on the first part magnetically coupled with the third coil. Thereby, a change of load by the sensing arrangement on the third coil transmits an alarm signed to the fourth coil.

The alarm system of this construction offers the advantage that the feeding circuit of the sensing arrangement on the primary side is separated from the reporting circuit on the secondary side. Therefore, no electrical connection exists between the two circuits so that this system can be inserted into reporting lines already provided for other alarms systems. The invention will be explained by way of illustration in connection with the attached drawings.

THE DRAWINGS

DETAILED DESCRIPTION

Figure 1:
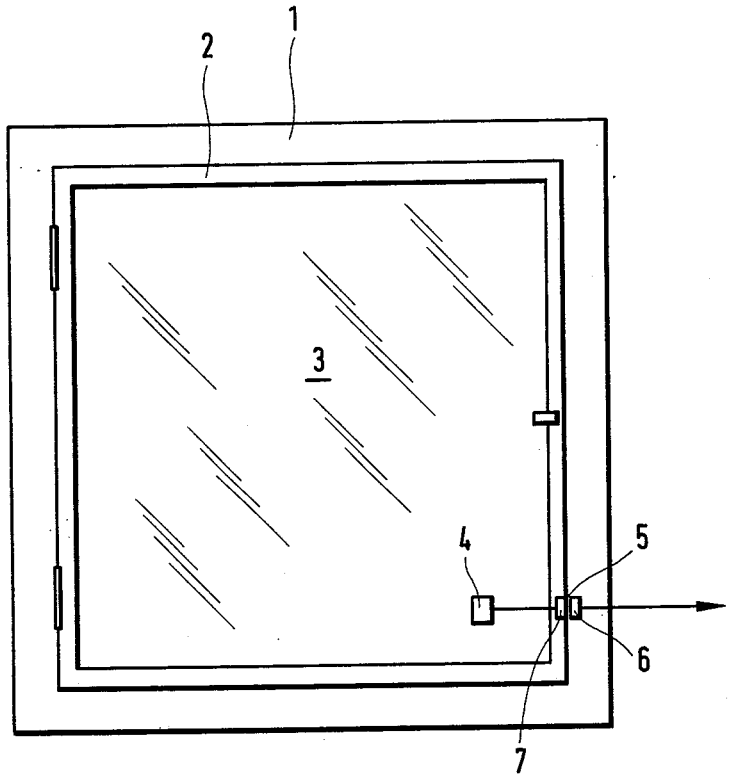
FIG. 1 is a top view of a window with a schematic representation of an alarm system attached thereon.
Figure 2:
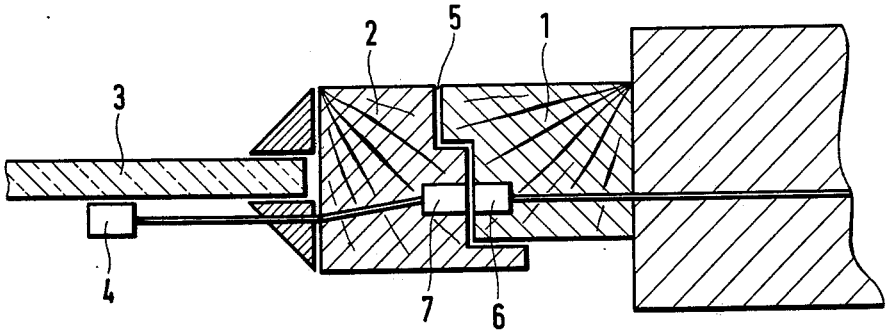
FIG. 2 is a partial sectional view of the alarm system of FIG. 1 on an enlarged scale.

In the case of the window shown in FIGS. 1 and 2, a wing or sash 2 of the window is mounted movably in a main window frame 1, which is seated in the masonary or the like. The window includes a glass pane 3 on which is disposed a glass break sensor 4 connected with a secondary unit 7. Separated by an air gap 5, a primary unit 6 is seated on the fixed window frame opposite the secondary unit 7 on the window sash, which secondary unit is connected with a central station.

Figure 3:
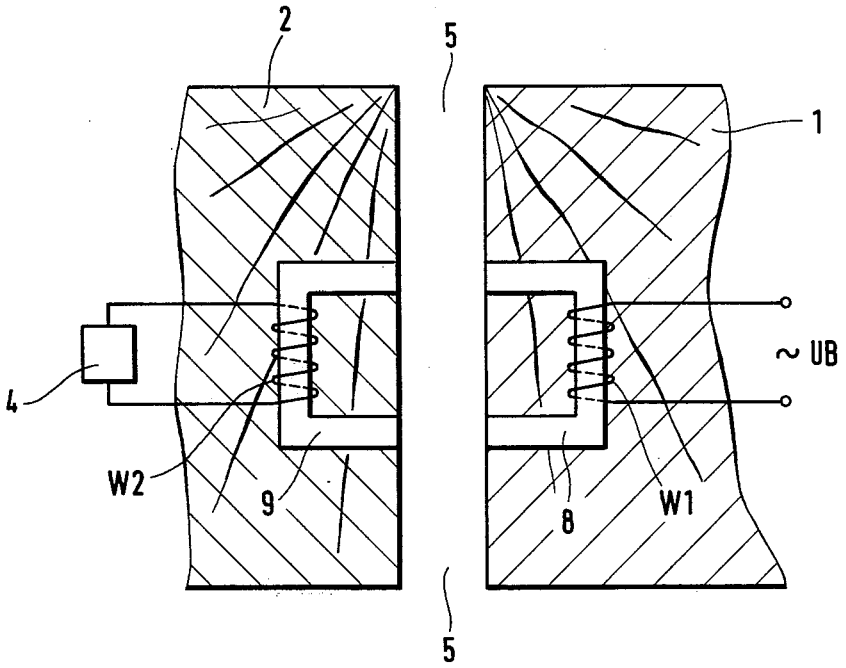
FIG. 3 is a diagrammatic view of one embodiment of the alarm system of FIGS. 1 and 2.

A first coil W1 (FIG. 3) is wound around an open core 8 arranged in a window or door frame 1, and is connected with an AC voltage UB. Separated by the gap 5 opposite open core 8, a second care 9 is disposed in the sash of the window or in the door 2, around which a second coil W2 has been wound. A sensor 4 is connected between the ends of coil W2. Whenever the window or the door is closed, a voltage is induced in the coil W2 by the magnetic alternating field bridging the gap 5, and this voltage is applied to the sensor 4. In the case of a change of resistance of the sensor 4, which is triggered, for example, by a shock, the load on the coil W2 changes. That results in a change of load on the coil W1, which change can be used for the triggering of an alarm by means of known arrangements. A corresponding change in load on the coil W1 does also develop whenever the window or the door 2 is opened (FIG. 3).

Figure 4:
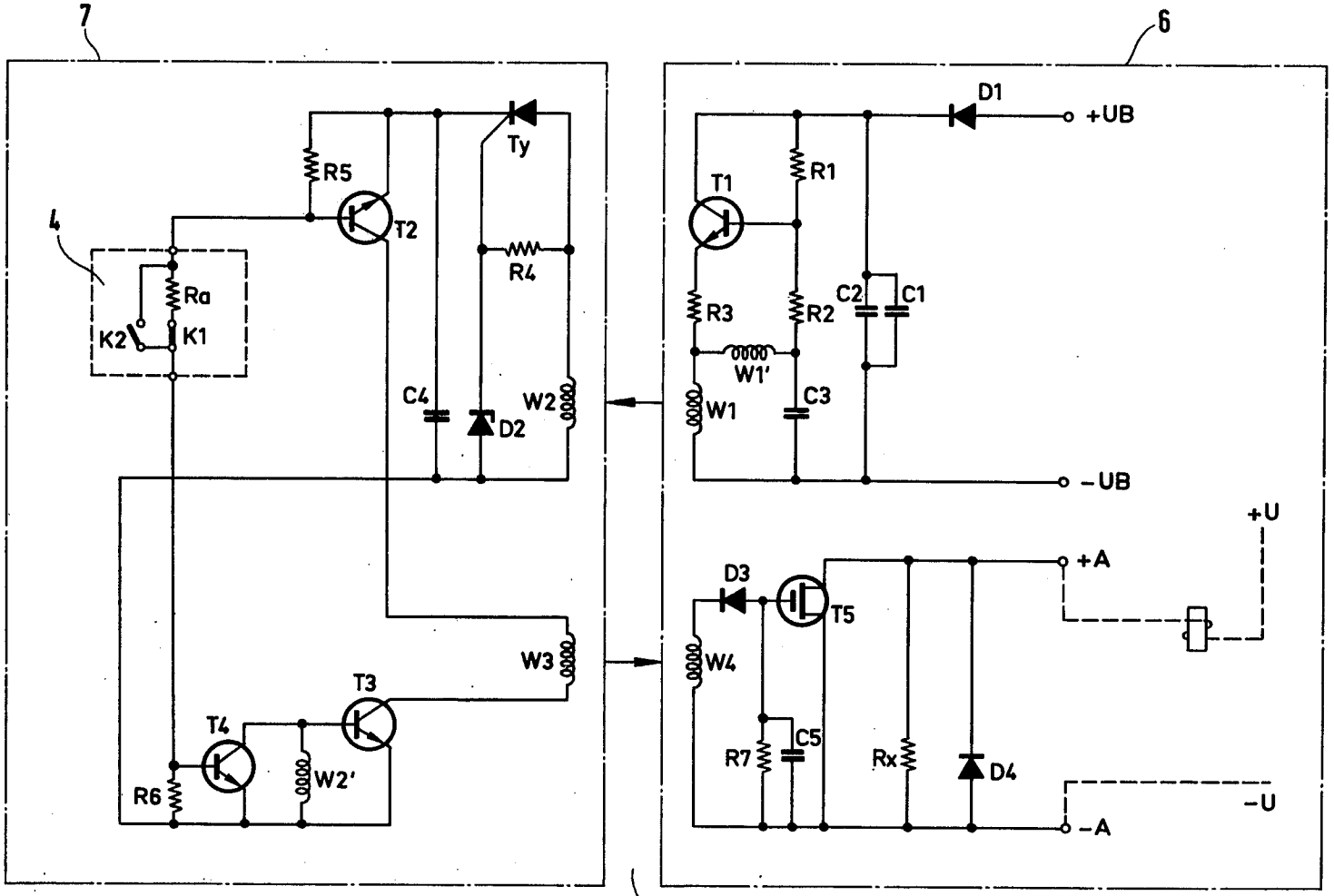
FIG. 4 is a diagrammatic view of a second embodiment of the alarm system.

FIG. 4 shows another embodiment using a primary unit 6 and secondary unit 7. In this case, a supply of DC voltage UB, which usually is between 10 and 16 V, is fed to an oscillator in Hartley connection by way of a diode D1. In the case of this circuit, three resistors R1, R2, R3, three capacitors C1, C2, C3, one transistor T1 and two coils W1 and W1′ are disposed in the manner shown in FIG. 3. The coil W1 of the oscillator circuit is a coil on an open core and mounted on the window frame 1 in such a way that a similar coil W2 mounted on the opposite wing or sash of the window 2 and separated by the gap 5 lies in the magnetic alternating field, so that an alternating voltage is induced in this coil W2. This alternating voltage is rectified and filtered by a control circuit which consists of a thyristor Ty, and resistor R4, a capacitor C4 and a diode D2. A voltage divider consisting of a resistor R5 and a resistor R6, as well as an external resistor Ra, is dimensioned such that the transistor T2 connects through or conducts and the transistors T4 is locked or shut off. Whenever a positively directed voltage develops in a coil W2' during the negative half wave in the soil W2, the transistor T3 connects through or conducts. Now a current can flow through a coil W3 via the transistor T2 and the capacitor C4. The coils W3 and W4 are mounted in such a way on the window sash 2, and the window frame 1, respectively, that a voltage will likewise be induced in the coil W4. This voltage reaches the gate of an FET transistor T5 via the diode D3 and locks or cuts off said gate. The capacitor C5 keeps the transistor T5 locked or cut off during the positive half wave. At the outlet, only the resistor Rx is effective.

Whenever the voltage divider ratio of the resistors R5, R6 and Ra is disturbed by breaking the line to the alarm release 4 or by triggering the alarm release 4 with the switches K1, K2, then either the transistor T2 locks or shuts off or the transistor T4 connects through or conducts, so that no current can flow through the coil W3. Now no voltge is induced in the coil W4. The capacitor C5 discharged by way of the resistor R7. The drain-source stretch or channel of the transistor T5 becomes low-resistance.

A reporting line of an alarm center or a relay for the triggering of the alarm can be connected directly to the outlet +A, −A or connected in other known ways to respond to the change in the sensor. The diode D4 protects the outlet during switching off of an inductive load. An alarm is also triggered by opening the window whenever transmission of the coil W4 can no longer take place. Furthermore, an alarm is triggered whenever the supply voltage UB is disturbed.

In the case of an alarm system according to the circuit diagram of FIG. 4 developed in practice, the individual construction units have the following values. In the case of the diodes, the thyristor and the transistor, the producer type has been given, whereby the individual data can be taken from the corresponding known data sheets. In the case of this connection, a frequency of about 35 kHz will be achieved on the coil W1 of the primary unit 6 with the Hartley oscillator circuit.

| | | | | | | |
|---|---|---|---|---|---|---|
| R1 = | 30 | kohm | 0.3 watt | D1 = | 1N 4446 | |
| R2 = | 4.7 | kohm | 0.3 watt | D2 = | ZPD 3.3 | |
| R3 = | 57 | ohm | 0.3 watt | D3 = | 1 N 4446 | |
| R4 = | 470 | ohm | 0.3 watt | D4 = | 1 N 4001 | |
| R5 = | 4.7 | kohm | 0.3 watt | Ty = | BRY 56 | |
| R6 = | 470 | ohm | 0.3 watt | T1 = | BC 238 B | |
| R7 = | 500 | kohm | 0.3 watt | | | |

-continued

| | | | | | | |
|---|---|---|---|---|---|---|
| Ra = | 10 | kohm | 0.3 watt | T2 = | BC 308 B | |
| Rx = | 22 | kohm | 0.3 watt | T3 = | BC 238 B | |
| C1 = | 10 | nf / | 25 volt ceramic | T4 = | BC 238 B | |
| C2 = | 1 | μF / | 25 volt tantalum | T5 = | 2 N 3819 | |
| C3 = | 2.2 | μF / | 60 volt ceramic | | | |
| C4 = | 1 | μF / | 25 volt tantalum | | | |
| C5 = | 2.2 | nF / | 60 volt ceramic | | | |

The following coils all have a half shell core type P 14×8 with an A1 value (magnetic conductance) of 2200. The windings of the coils consist of lacquer insulated coper wire with a diameter of 0.06 mm. Winding number:

$W1 = 300$; $W1' = 150$; $W2 = 400$; $W2' = 100$; $W3 = 300$; $W4 = 600$

What is claimed is:

1. In an alarm system with a sensor arrangement including a break responsive means on a relatively movable part energized from a source of electric energy on a locally fixed part, the improvement comprising:

a first coil on an open core disposed on said fixed part for connection to a circuit including an alternating voltage source;

a second coil electrically coupled to the sensor arrangement on a second core disposed on the relatively movable part, so that said first coil transmits energy to said second coil when said parts are in normal adjacent position;

a third coil on an open core mounted on said relatively movable part and connected to the sensor arrangement to normally maintain one state of operation; and a fourth coil on an open core mounted on said fixed part;

said cores carrying said third and fourth coils being spaced apart with the coils thereon magnetically coupled with said parts are in normal adjacent position; and circuit means interconnecting said sensor arrangement and said second and third coils whereby actuation of the sensor arrangement will cause a change in the state of energization of said third and fourth coils.

2. An alarm system as claimed in claim 1 wherein an alarm means is connected in circuit with said fourth coil for indicating actuation of the sensor.

3. An alarm system as recited in claim 1 wherein:

said relatively movable part is a member for closing an opening in said locally fixed part; and said sensor arrangement forms part of a voltage divider circuit which is electrically energized from said second coil through said first coil to maintan said third coil energized when said sensor arrangement is in normal condition and to de-energize said third coil when said sensor arrangement is actuated.

* * * * *